United States Patent [19]

Schoonderbeek

[11] Patent Number: 4,738,739

[45] Date of Patent: Apr. 19, 1988

[54] CONNECTING DEVICE FOR TWO MATERIAL BANDS OR STRIPS, AS WELL AS A METHOD FOR OPERATING SUCH A DEVICE

[75] Inventor: Hubertus J. Schoonderbeek, Beuningen, Netherlands

[73] Assignee: Stork Brabant B.V., Netherlands

[21] Appl. No.: 832,056

[22] Filed: Feb. 21, 1986

[30] Foreign Application Priority Data

Feb. 21, 1985 [NL] Netherlands ..... 8500490

[51] Int. Cl.[4] ..... B31F 5/00; B65H 19/00

[52] U.S. Cl. ..... 156/159; 156/502; 156/504; 242/58.3; 242/58.4

[58] Field of Search ..... 156/159, 157, 502, 504, 156/505, 507, 511, 517, 304.1, 304.3, 263, 555; 242/58.1, 58.3, 58.4, 58.5

[56] References Cited

U.S. PATENT DOCUMENTS 3,880,698 4/1975 Kawazura et al. ..... 242/58.4 X
4,170,866 10/1986 Aschenbrenner et al. ..... 57/58.95
4,190,475 2/1980 Marschke ..... 156/504 X

FOREIGN PATENT DOCUMENTS 2218502 11/1973 Fed. Rep. of Germany .

*Primary Examiner*—Donald E. Czaja
*Assistant Examiner*—Geoffrey L. Knable
*Attorney, Agent, or Firm*—Ostrolenk, Faber, Gerb & Soffen

[57] ABSTRACT

A semi-automatic operating and also adjustable device for interconnecting the opposite ends of two material bands originating from two individual webs, one web of which is nearly terminated the other being the starting one, the connection being made with an adhesive tape attached to only one and the same side of both bands, said device comprising two pinch rollers, cutting knives and idler rollers, the band material being either paper or textile, to be used for a printing operation.

8 Claims, 5 Drawing Sheets

CONNECTING DEVICE FOR TWO MATERIAL BANDS OR STRIPS, AS WELL AS A METHOD FOR OPERATING SUCH A DEVICE

BACKGROUND OF THE INVENTION

The invention relates to a device for attaching the severed parts of a band to one another. The trailing edge of a first terminating material band which is subjected to a treatment or to an operation in its downstream portion is connected to the leading edge of a second starting band. Included are a frame equipped with a means for the rotatable support of a supply roll or web for the first and second material bands and two cooperating, parallel pinch rollers. Each of the bands is guided along one of these rollers. A number of idler rollers are incorporated in the paths of the bands between each supply roll or web and the associated pinch roller. A device as described above comes in various embodiments, especially in relation to bands which are provided on both sides with an adhesive paste or adhesive tape.

Depending upon the intended use of the material band (usually used for printing purposes), there exists a need to connect two successive band ends, e.g., by either overlapping or abutting their edges. This task imposes a high degree of care and precision on the machine operator who is called upon to carry out this task.

SUMMARY OF THE INVENTION

It is an object of the invention to provide a method in which a precise, pre-determined type of connection can be achieved for connecting two successive bands.

The foregoing and other objects are achieved according to the invention, by mounting one pinch roller on a stationary support and by incorporating the other pinch roller in a pivotal support which is displaceable between two adjustable stops, in such a way that an imaginary plane passing through the axes of both pinch rollers can assume two extreme angular positions, which are symmetrically located with respect to a central position. Further means are present for bringing together or separating the pinch rollers. By first adjusting the abovementioned stops and thereby the pivotal angle, the device can be trimmed so that only the desired and pre-determined type of connection without undesired variations, between the two successive material bands can be achieved. The machine operator has sufficient time to pre-set the device to achieve the desired type of connection. Thereafter, the device automatically performs the connecting operation at the proper instant. The invention also provides a method for the operation of the abovementioned device, in combination with a loop-accumulator a device which enables the trailing edge of a terminating material band to be brought to a standstill for a short time, without impeding the treatment or the operation taking place downstream of the band. The method is characterized in that certain preparatory steps have first to be taken:

- with the help of the pivotal support, the angle of the two pinch rollers with respect to each other, is adjusted (to determine the degree of overlap);
- the starting material band is severed at a fixed place on the outer surface of the associated pinch roller and is pressed against it by means of suction;

- an adhesive tape is placed on the severed edge of the material band;

thereafter the following steps are taken:

- the forward movement of the terminating band is stopped, which in turn initiates the movement of the accumulator;
- after the terminating band is stationary, the pinch rollers are pressed together;
- the terminating band is then severed at a fixed distance upstream from the associated pinch roller;
- the trailing edge of the terminating band is once again set in motion and thereby both the pinch rollers, so that the trailing edge is pressed against the other pinch roller, enabling it to make contact with the adhesive tape;
- the forward movement of the band so connected is thereby restored and the pinch rollers are separated enabling the accumulator to assume its original status.

BRIEF DESCRIPTION OF THE DRAWINGS

The invention will be elucidated by means of the accompanying drawing, which depict the apparatus of the invention and which illustrate a number of successive stages of the method.

FIG. 3 shows the operation of the connecting device in seven successive stages, a to g, in the position corresponding to FIG. 4*c*.

DESCRIPTION OF A PREFERRED EMBODIMENT

Figure 1:
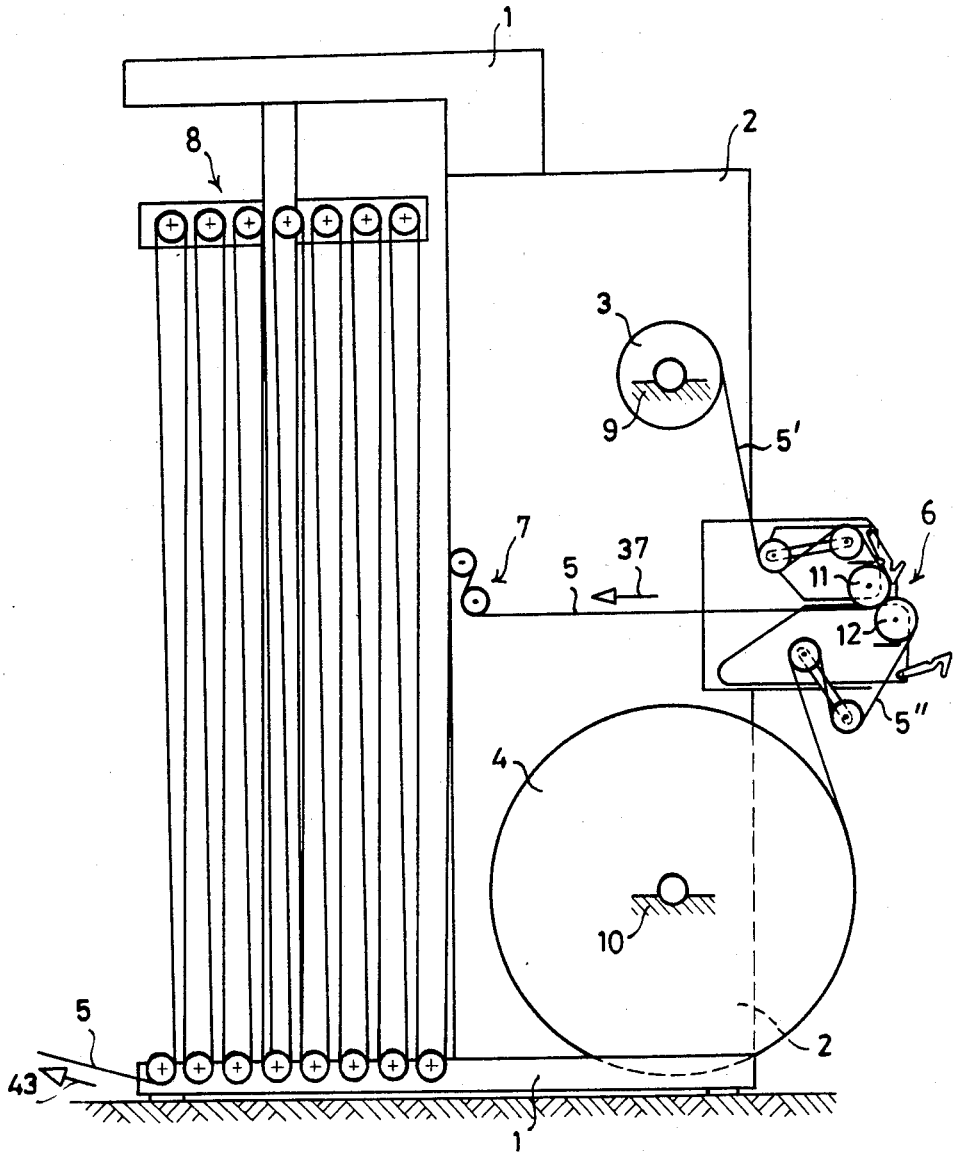
FIG. 1 shows an overview of the device in combination with a loop accumulator.

The apparatus of FIG. 1 concerns a part of the roller exchanger for the attachment of bands (e.g., paper) utilizing an adhesive medium. The schematically represented device includes a frame 1 having a built in derrick 2, which is suitable for the rotatable support of two rolls or webs 3 and 4 of the material band 5, to be printed. In the illustrated situation, the upper web 3, supplies the band 5 to be printed, via device 6 to a pair of rollers 7, which form an entry point to loop accumulator 8.

The band 5 originating from the web 3, constitutes in the illustrated case, as well as in FIGS. 2 and 3, a so-called terminating band 5'. The band originating from the web 4, constitutes a so-called starting band 5''. These functions interchange periodically, depending upon whether the lower web 4, or the upper web 3, supplies the band 5 to the printing press (not shown).

Figure 2A:
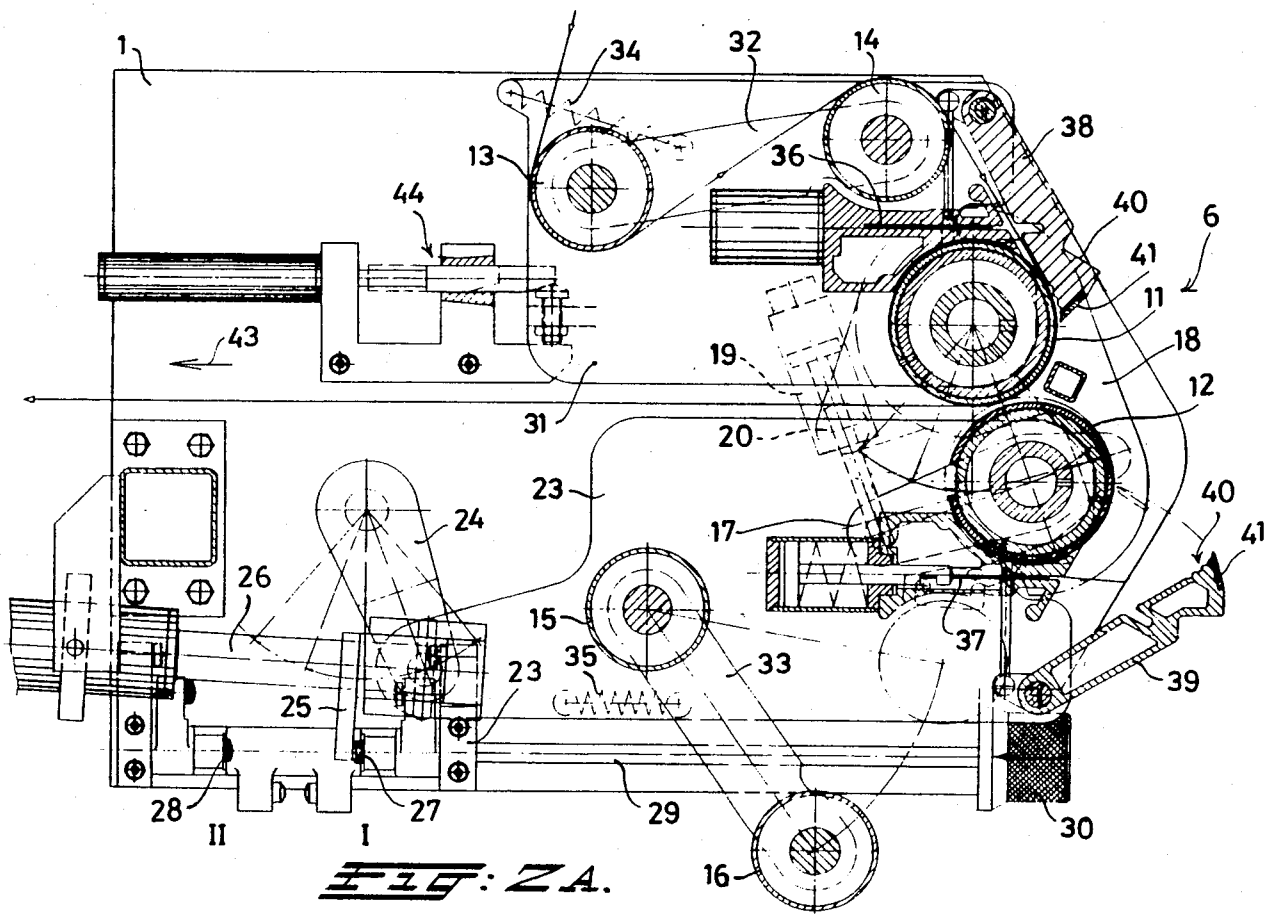
FIGS. 2A to 2C show side views on a somewhat enlarged scale, of the entire connecting device and parts of the device shown in FIG. 1, in greater detail.
Figure 2B:
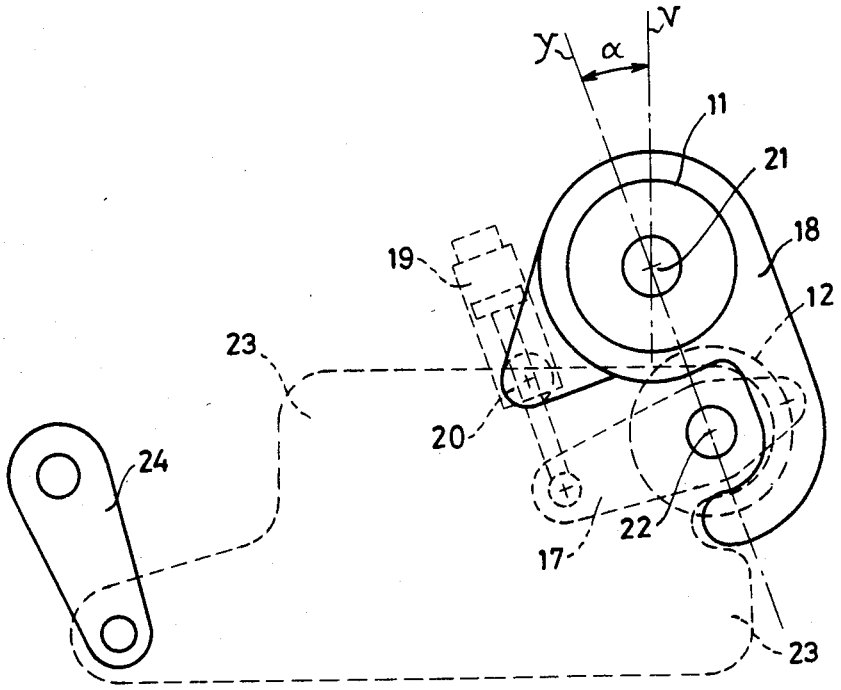
Figure 2C:
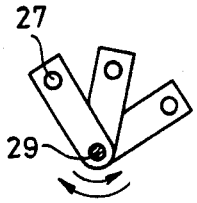

Structurally, the invention is embodied in the device 6 which is shown in FIGS. 2A and 2B on an enlarged scale. FIG. 2A as well as stage 3*a* show the situation corresponding to FIG. 1, whereas the stages 3*f* and 3*g* show the situation as soon as the lower web 4 is almost exhausted and that a connection should be made with the band originating from the full web 3. The object is always to establish a connection between the trailing (downstream) edge of the first band (terminating band 5') and the leading (upstream) edge of a second band (the starting band 5").

The derrick 2 of the frame 1, is equipped with a support 9, for providing a rotatable support for upper web 3 and with a support 10, for lower web 4.

The device 6 is equipped with two co-operating, parallel pinch rollers 11 and 12. The band 5 from the upper web 3, is guided along roller 11 and band 5 is guided from lower web 4, along roller 12.

Further, a couple of idler rollers 13 and 14 are located in the path between the upper web 3 and pinch roller 11. In the material path between lower web 4 and pinch roller 12, there are likewise provided a couple of idler rollers 15 and 16. The upper pinch roller 11, is mounted in the frame 1 and the lower pinch roller 12 is mounted to a lever arm 17. One end of this arm is pivotally attached to a hook-shaped member 18 (see FIG. 2B), which is pivotally supported in the frame 1, around a common axis with the fixed pinch roller 11. The free end of the lever arm 17, is connected to an adjustment piston 19, which is supported at 20, on an extension of the hook-shaped member 18.

Figure 4:
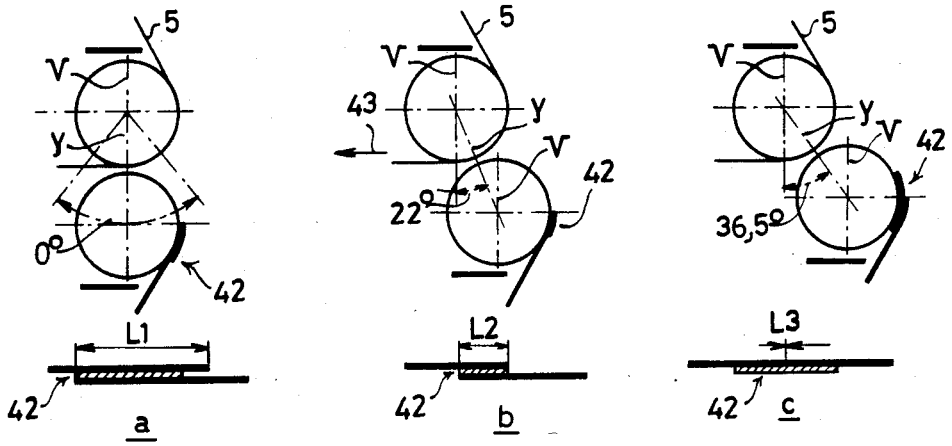
FIG. 4 shows three different positions of the device together with the relevant types of connection obtained.
Figure 5:
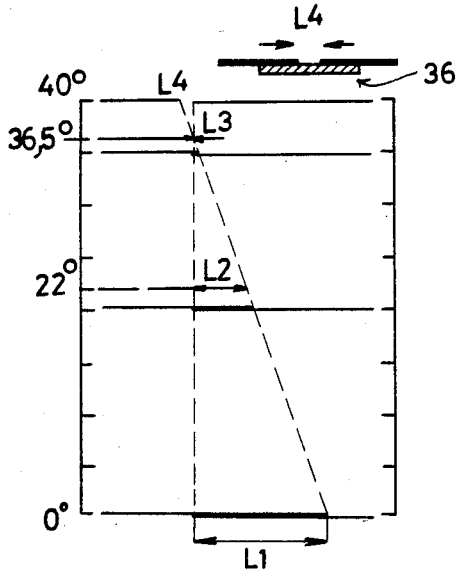

The pinch roller 12 is rotatably supported on lever arm 17, so that by operation of adjustment piston 19, the distance between the rollers 11 and 12 can be increased, bringing roller 12 out of contact with roller 11, or can be decreased, reestablishing the contact between the rollers. Further, by pivoting the hook-shaped member 18 around its axis 21 and by positioning the rollers in a manner hereinafter described, the angle $\alpha$ between an imaginary plane Y, passing through two parallel axes 21 and 22 of pinch rollers 11 and 12 respectively, and a vertical plane V through the axis 21 or 22 of one of the two rollers 11 or 12 can be varied as shown in FIG. 4.

To achieve this, there is provided a supporting plate 23, which is journalled upon the axis of the lower pinch roller 12. The supporting plate 23 is also carried by a second pivotal arm 24. Further there is a projection 25 displaceable between two adjustable limits I and II. The projection is connected to plate 23 and to an operating rod 26.

The projection 25 abuts against and stops 27 and 28, corresponding to the limits I and II respectively, by which the aforementioned angle $\alpha$ is determined. In the example illustrated in FIG. 2A, three pairs of stops are shown, corresponding to three different values of $\alpha$, (which will be explained later with reference to FIGS. 4 and 5). These three pairs of stops 27 and 28 respectively are radially mounted on a rod 29 (see FIGS. 2A and 2C) and can be set by means of a knob 30 in the desired position. This establishes the position of the supporting plate 23 and thereby also the position of the adjustable pinch roller 12.

The fixed pinch roller 11 is also equipped with a specially shaped support plate 31, which is mounted in frame 1, co-axially with roller 11. The first idler roller 13 is mounted on the same support plate 31. The first idler roller 15 is mounted on the plate 23. The second idler roller 14 (16), is mounted on the distal end of an arm 32, (33) respectively, the other end of which is mounted concentrically with first idler roller 13, (15). In addition a spring, 34, (35) is provided, which separates the second idler roller 14, (16) respectively, from the pinch roller 11, (12), which is mounted on the support plate 31, (23) respectively.

Each support plate 31, (23) is equipped with an adjustable knife, 36, (37) respectively. This knife operates in co-ordination with a slit-shaped anvil incorporated in a hanged flat shaped arm 38, (39) which is mounted on the support plate 31, (23) respectively. Each of these arms 38, (39) has a concave part 40, the radius of which corresponds to the arc of the pinch roller 11, (12). A cutting edge 41 is incorporated at the extremities of each arm 38, 39. Each of said arms can be pressed with the concave part 40 with the aid of a clamping means (not shown), against the associated pinch roller 11 and 12 respectively, so that the free end of the starting band 5" can be severed off along the cutting edge 41.

The adjustable pinch roller 12 can assume three angular positions with respect to the fixed pinch roller 11, in the situation when the upper web 3 supplies the terminating band 5' and also in a similar situation in the case of the lower web 4. These positions correspond with the positions of the arm 24 (shown dotted in FIG. 2A) and are instrumental in determining the type of connection to be executed. The positions of the pair of stops 27, 28 are instrumental in fixing the angle $\alpha$ between the plate Y of both the pinch rollers 11, 12 on the one hand and the vertical plane V through the axes of 21 and 22 respectively, of one of the two rollers on the other. This angle is either positive or negative with respect to the vertical position of the plane Y, dependent upon whether the terminating band 5' originates from web 3, or from lower web 4.

To summarize and to facilitate reference to the previously described structures and elements, the present invention may be said to include a "moving mechanism" which provides the capability of moving the second pinch roller 12 between the two extreme angular positions. The moving mechanism includes: the pivotably supported hook-shaped member 18, lever arm 17, support plate 23, pivotal arm 24 and operating rod 26.

As previously described and as set forth more fully below, the present invention provides the ability of forming a splice connection in which the degree of overlap, or spacing if desired, between the bands which are being connected to one another is controllable. The ability to control the degree of overlap or spacing results from the adjustable location of the plane Y relative to the vertical plane V to thereby adjust the location of the contact region between the pinch rollers 11, 12 as shown in FIGS. 4*a*, 4*b*, and 4*c*. The adjustment determines the type of splice connection that will be obtained.

With the help of stages a to g in FIG. 3, the sequential operation of device 6 is explained below. In FIGS. 1 and 3*a* represent a starting point, showing an almost empty upper web 3 with its terminating band 5' and a lower stocked web 4 with its upstream starting band 5". The band 5 from the web 3 passes via the idler rollers 13, 14, along the pinch roller 11. The end of the starting band 5" from web 4 passes via the idler rollers 15, 16 along the pinch roller 12. With help of cutting edge 41 on the arm 39, band 5" is severed along a fixed place on the outside of the pinch roller 12 and is held there by suction (see FIG. 3*a*). Thereafter, arm 39 is turned away and a double-sided adhesive tape 42, is placed upon the severed edge of the band 5" (see FIGS. 3*b* and 4*b*). During this preparatory phase, (which is now completed), band 5, originating from web 3, travels in the direction of the arrow 43 towards loop accumulator 8. Pinch rollers 11, 12 shown in FIGS. 2A and 4*b* are relatively positioned so that $\alpha=20°$. This situation results in a small overlap, L2. A maximum overlap L1 is obtained when $\alpha=0°$, in accordance with the situation in FIG. 4*a*. The edges will abut as shown in L3 when the situation is in accordance with FIG. 4c, when $\alpha=36.5°$. Half of the single-sided adhesive tape 42, is then under the edge of the starting band 5''. This value of the angle $\alpha$ could e.g., be utilized when only one side of the band 5 is compatible with the adhesive tape 42.

At the instant of web exchange, the movement of the terminating band originating from web 3 is stopped and the operation of the loop accumulator is automatically initiated. The part of the band 5, downstream of the accumulator can continue its travel for the intended operation, while the upstream part 5' is stationary. The rollers 11, 12 are moved towards each other with the help of of the pneumatic adjustable piston 19. Thereafter knife 36 is displaced to the right, so that the (stationary) terminating band 5' is severed (see FIG. 3c). The arm 32, moves upwards with the help of the spring 34, (see FIG. 3d) so that with the next web exchange (the lower web 4 is then terminating) a shock load is not transmitted to the tape.

The trailing end of the terminating band 5' is completely free after it is severed and is drawn towards the pressed together pinch rollers 11, 12. This trailing end 5' is of a pre-determined length which is determined by the distance of the anvil in the arm 38 to the clamping point where the pinch rollers 11, 12 are in contact. This length is such that after the end 5' has passed through the point of contact of the pinch rollers 11, 12, the abutting connection L3 can be realized (see FIG. 3d).

Thereafter the pinching of rollers 11, 12 is released, enabling the loop accumulator 8 to return to its original status. This sequence of operations completes the switchover from upper web 3 to the lower web 4.

Figure 5:
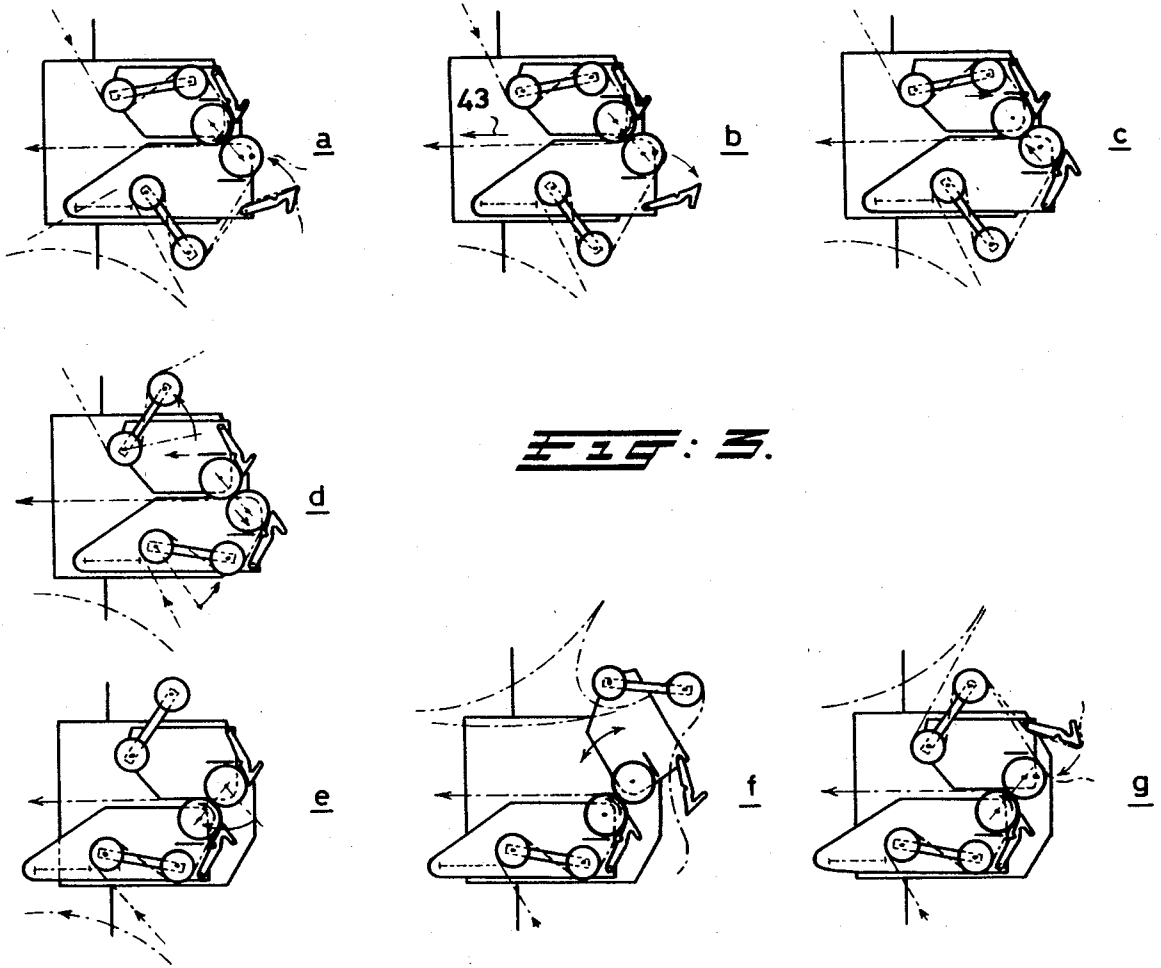
FIG. 5 is a graphic representation of the type of connection that can be achieved, in relation to the adjustment of the device.

As shown in FIGS. 4a and 5, the angle between the planes Y and V can be varied from $+40°$ to $-40°$. The two extreme limits are not likely to be utilized, since the resultant overlap would be too small (see L4). When $\alpha=0°$ (the roller 12 is vertically under the roller 11), the resultant overlap, L1 is more than adequate (see FIG. 4a). When $\alpha=22°$, the resultant overlap L2 is small (see FIG. 4b). When $\alpha=36.5°$ an abutting connection L3 is realized.

FIGS. 3f and 3g show the situation when the terminating band originates from the lower web 4 and the starting band originates from the upper web 3. The topmost support 31 can then be released from the position shown in FIG. 2A, by retracting a wedge-shaped lock 44. The end of the band originating from web 3 can then easily be fed along the idler rollers 13 and 14 (see FIG. 3f). Thereafter this starting band is severed at a fixed place on the outside of the pinch roller 11, by the cutting edge 41 on the arm 38 (see FIG. 3g). Thereafter an adhesive tape 42 is placed on the severed end 5' and in such a way that the connection made is in accordance with L1, L2. These operations conclude the preparatory phase for the next connection to be made.

Each time a connection has to to be made between the terminating band and the starting band, the procedure described above is repeated, commencing with the (re)-adjustment of the angel $\alpha$ or maintenance of the current adjustment. This is achieved by selecting the appropriate pair of stops 27,28, the eventual turning of rod 29 and the energization of operating rod 26.

Hereafter the advance of the terminating band is stopped and the preparatory steps are once again taken for the following connection to be made, etc. Every available value of $\alpha$ can be set with the help of knob 30 and operating rod 26 and thereby every predetermined type of connection can be made between two successive bands.

It should be noted the both pinch rollers 11, 12 are equipped with perforations connected to a vacuum source, for temporarily holding the severed or torn off band 5.

What is claimed is:

1. A splicing apparatus for attaching a trailing end of a first material band supplied from a first source to the leading end of a second material band supplied from a second source with a splice connection, said apparatus being capable of controlling the degree of overlap or spacing of the bands at the splice connection, said apparatus comprising:

means for rotatably supporting the first and second band sources;

first and second cooperating pinch rollers (11, 12) rotatably mounted to rotate respectively about first and second parallel axes (21, 22), the first and second material bands being guided, respectively, by the first and second pinch rollers, the first pinch roller being supported on a frame (1) and the second pinch roller (12) being movable relative to the first pinch roller such that an imaginary plane (Y) passing through said first and second axes is capable of spanning between first and second extreme angular positions, the extreme angular positions being referenced to a central position (v);

a moving mechanism (18, 17, 23, 24, 26) effective for moving the second pinch roller (12) between the extreme angular positions, the moving mechanism being effective for adjusting the actual position of the second pinch roller at a selected position between the extreme angular positions to control the degree of overlap or spacing of the bands at the splice connection; and means for selectively pressing or separating the pinch rollers to or from one another.

2. An apparatus according to claim 1, in which the moving mechanism comprises a pivotably supported member (18), the first pinch roller (11) being mounted on a common axis with the pivotably supported member (18), a lever (17) having a first end which is swivelably mounted to the pivotably supported member (18) and a second end, the second pinch roller (12) being supported on the lever (17) between its first and second ends.

3. An apparatus according to claim 2, in which the means for pressing or separating the pinch rollers (11, 12) includes a piston rod (20), the piston rod (20) being coupled to the second end of the lever (17) and being effective for selectively pressing or separating the pinch rollers (11, 12) from one another.

4. An apparatus according to claim 2, further including a first support structure (31) for the first pinch roller (11) and a second support structure (23) for the second pinch roller (12), a first idler roller (13) associated with the first pinch roller (11) and mounted to the first support structure (31) and a second idler roller (15) associated with the second pinch roller (12) and supported on the second support structure (23), the moving mechanism including a pivotable arm (24), the second support structure (23) being coupled to the pivotable arm (24) and to the pivotably supported member (18) to allow movement of the second support structure (23) to enable the second pinch roller (12) to move between the extreme angular positions.

5. An apparatus according to claim 4, further comprising secondary first and second idler rollers (14, 16) which are coupled to and respectively associated with the first and second idler rollers (13, 15).

6. An apparatus according to claim 4 further comprising first and second slidably mounted knives located respectively on the first and second support structures, a respective rotatably supported arm-shaped anvil on the first and second structures and means for operating the knives and the anvils in a manner which is effective for selectively cutting the first and second material bands at respective predetermined locations.

7. An apparatus according to claim 6, the moving mechanism further comprising an operating rod (26) which is coupled to the second support structure (23), and further comprising a projection (25) located on the second support structure (23) which cooperates with end stops (27, 28) in a manner which is effective for selectively controlling the degree of overlap or spacing of the bands at the splice connection between the terminating end and the leading end of the material bands.

8. A method for splicing a trailing end of a first material band supplied from a first source to a leading end of a second material band supplied from a second source with a splice connection in which the degree of overlap or spacing of the bands at the splice connection is controllable, the method comprising the steps of:

rotatably supporting the first and second sources;

guiding the first band to a first pinch roller (11) which is rotatable about a first axis of rotation (21) and guiding the second band to a second pinch roller (12) which is rotatable about a second axis of rotation (22), the axes (21, 22) being parallel to one another and the first and second pinch rollers (11, 12) being movable to contact each other at a contact region therebetween, the axis of rotation (22) of one of the pinch rollers (12) being movable with respect to the other axis of rotation (21) in a manner which enables adjusting the position of the contact region between the first and second rollers (11, 12), the contact region being intersected by an imaginary plane (Y) passing through the axes (21, 22), the imaginary plane (Y) having an angular position which is referenced to a vertical plane (V), the angular position of the imaginary plane determining the degree of overlap or spacing that is provided in the splice connection;

adjusting the location of the second pinch roller (12) to select and fix the angular position of the imaginary plane (Y);

severing the material band associated with the leading end at a predetermined location thereof relative to the second pinch roller;

adhering an adhesive tape to the severed leading end;

arresting the motion of the first pinch roller but continually feeding the first material band from a loop accumulator where a length of the first material band has been stored;

pressing the first and second pinch rollers against each other;

clamping the trailing end between the first and second pinch rollers;

severing the trailing end at a predetermined location relative to the first pinch roller;

setting both the first and the second pinch rollers into motion in a manner which is effective to adhere the trailing end to the adhesive tape; and separating the first and second pinch rollers to enable the material band to be fed from the second source.

* * * * *